US006109336A

United States Patent [19]

Pronk et al.

[11] Patent Number: 6,109,336

[45] Date of Patent: Aug. 29, 2000

[54] METHOD OF MANUFACTURING A DEEP-DRAWING STEEL STRIP OR SHEET

[75] Inventors: Cornelis Pronk, Castricum; Huibert Willem Den Hartog, Noordwijkerhout, both of Netherlands

[73] Assignee: Hoogovens Staal BV, Ijmuiden, Netherlands

[21] Appl. No.: 08/983,084

[22] PCT Filed: Jun. 28, 1996

[86] PCT No.: PCT/EP96/02875

§ 371 Date: Oct. 23, 1998

§ 102(e) Date: Oct. 23, 1998

[51] Int. Cl.[7] ..... B21B 1/46; C21D 8/04

[52] U.S. Cl. ..... 164/476; 148/541; 148/546; 164/477

[58] Field of Search ..... 164/476, 477; 148/541, 546

[56] References Cited

U.S. PATENT DOCUMENTS

| | | | |
|---|---|---|---|
| 4,885,041 | 12/1989 | Den Hartog et al. | 148/602 |
| 5,042,564 | 8/1991 | Van Perlstein et al. | 164/477 X |

FOREIGN PATENT DOCUMENTS

| | | |
|---|---|---|
| 0 504 999 | 9/1992 | European Pat. Off. . |
| 0 524 162 | 1/1993 | European Pat. Off. . |
| 0521808 | 1/1993 | European Pat. Off. . |
| 0 659 891 | 6/1995 | European Pat. Off. . |
| 923 134 | 3/1955 | Germany . |
| 62-114701 | 5/1987 | Japan . |
| 63-145719 | 6/1988 | Japan . |
| WO92/22389 | 12/1992 | WIPO . |

*Primary Examiner*—J. Reed Batten, Jr.
*Attorney, Agent, or Firm*—Stevens, Davis, Miller & Mosher, LLP

[57] ABSTRACT

In the manufacture of steel strip or sheet, suitable for use as deep-drawing steel for the manufacture of can bodies by deep-drawing and ironing, a low-carbon steel is provided in the form of a slab, the slab is rolled in the austenitic region to reduce its thickness to a transfer thickness, the rolled slab is cooled having the transfer thickness into the ferritic region, and the rolled slab is rolled in the ferritic region to a finished thickness. To provide a steel having reduced tendency to "earing" in can body manufacture, the transfer thickness is less than 1.8 mm and the total thickness reduction in the ferritic region from the transfer thickness to the finished thickness is less than 90%.

19 Claims, 2 Drawing Sheets

3
2
6
10
12
14
34
36
K
28
H
38
I
4
5
7
9
11
13
35
33
G
29
A
F
37
B
31
D
C
E
16
41
42
40
43

1
3
2
4
5
7
8
9
11
23
15
17
19
21
13
25
27
35
33
29
C
D
E
41
42
40
43
46
44
45

METHOD OF MANUFACTURING A DEEP-DRAWING STEEL STRIP OR SHEET

FIELD OF THE INVENTION

The invention relates to a method for the manufacture of a steel strip or sheet which is suitable as deep-drawing steel for the manufacture of for example steel can bodies by deep-drawing and ironing. Ironing is also sometimes called wall-thinning.

DESCRIPTION OF THE PRIOR ART

To be suitable as deep-drawing steel, a grade of steel must fulfil a number of requirements, several important ones of which are discussed in the following.

To obtain a closed, so-called two-piece can, the first piece of which comprises the body including the base and the second piece is the lid, a flat blank of deep-drawing steel is taken for the first piece which flat blank is first deep-drawn into a cup with a diameter of, for example 90 mm and a height of, for example 30 mm, and which cup is then ironed into the can with a diameter of, for example 66 mm, and a height of, for example 115 mm. Indicative values for the thickness of the steel material in the different production stages are: starting thickness of the blank 0.26 mm, base thickness and wall thickness of the cup 0.26 mm, base thickness of the can 0.26 mm, wall thickness of the can at half height 0.09 mm, thickness of the top edge of the can 0.15 mm.

As this example shows, for making cans deep-drawing steel must have good formability and must retain this property over time too, to allow for storage and transport. In other words, deep-drawing steel must not be susceptible to ageing. Ageing leads to high forming forces, cracking during forming and surface defects from stretcher strains. A way of countering ageing is so-called over-ageing, wherein carbon, that contributes to a great extent to ageing symptoms, is separated in a controlled manner and can no longer diffuse to dislocations in the steel.

The desire to save material by being able to use increasingly lighter cans also acts on the requirement for high formability in order, from a given starting thickness to the blank, to be able to achieve the smallest possible finished thickness of the can wall and also of the top edge of the can. The top edge of the can places particular requirements on the deep-drawing steel. After the can has been formed by ironing, the top edge is reduced in diameter, so-called necking, in order to enable use of a smaller lid and so save on lid material. After necking, a flange is applied along the top of the top edge to enable the lid to be attached. The necking in particular and applying the flange are processes which place high requirements on the additional formability of the deep-drawing steel that was already formed earlier when the body was being made.

Besides the formability the purity of the steel is important. Purity is taken to mean the degree of absence of mainly oxidic or gaseous inclusions. Such inclusions occur in steel making in an oxygen steel plant and from the casting powder that is used in the continuous casting of the steel slab which is the base material for the deep-drawing steel. In the case of necking or forming of the flange, an inclusion can give rise to a crack which itself is the cause of a later leak in the can when filled with contents and closed. In the case of storage and transport, contents leaking out of the can may cause damage, in particular by contamination, to other cans or goods in its vicinity exceeding many times the value of the leaking can and its contents. The more the thickness of the edge of the can is reduced, the more becomes the risk of a crack as a consequence of an inclusion. Therefore, deep-drawing steel must be free from an inclusions. In as much as inclusions are unavoidable with the present method of steel making, these should be small in size and occur only in very small amounts.

Another requirement relates to the degree of anisotropy of the deep-drawing steel. In the manufacture of a deep-drawn/ironed or wall-thinned two piece can, the top edge of the can does not extend in a flat plane, but rather it displays a wave pattern around the circumference of the can. In the industry the wave peaks are known as ears. The tendency to form ears ("earing") is a consequence of anisotropy in the deep-drawing steel. The ears must be cut back to the lowest trough in order to obtain a top edge laying in a flat plane which can be formed into a flange, and this results in material loss.

From considerations of process operation it is usual to start with a hot-rolled sheet or strip with a thickness of 1.8 mm or more. With an approximately 85% reduction this arrives at a final thickness of approximately 0.27 mm. In connection with the search for less material use per can, a smaller finished thickness, preferably smaller than 0.21 mm, is desired. Standard values of approximately 0.17 mm have already been named. Thus for a given starting thickness of approximately 1.8 mm a reduction of over 90% is required. With the conventional carbon concentrations this leads to a heavy ear formation, the cutting away of which leads to extra material loss and negates a part of the benefit of smaller thickness. A solution is sought in using extra or ultra low carbon steel (ULC steel). Such steel with normally acceptable carbon concentrations of below 0.01% to values of 0.001% or less is made in an oxygen steel plant by blowing more oxygen into the steel bath and combusting more carbon. After this, if desired a vacuum ladle treatment can follow for further reducing the carbon concentration. By supplying more oxygen into the steel bath undesired metallic oxides also form in the steel bath which remain as inclusions in the cast slab and later in the cold-rolled strip. The effect of inclusions is amplified by the smaller finished thickness of the cold-rolled steel. As discussed, inclusions are detrimental because they can lead to cracking. As a consequence of the smaller finished thickness, this disadvantage is the more applicable of ULC steel. The result is that the yield of ULC steel grades for packaging purposes is low because of the high volume of rejection.

EP-A-521808 describes a process of producing a steel intended for use in making cans, having in the example given a final thickness of 0.18 mm. The process involves hot-rolling in the austenitic region followed by cold-rolling, with a reheating to for example 660° C. between two cold-rolling stages. The steel used has a carbon content of 0.005 to 0.15%. No thicknesses of the steel in the austenitic rolling are mentioned.

EP-A-504999 describes a process in which a slab is continuously cast at a thickness, following "squeezing" before the core is solidified, of 45 mm. In a single roll stand, this thickness is reduced to 15 mm. Subsequently this slab may be re-heated, and it may then be coiled. It is thereafter rolled in a continuous rolling, first in the austenitic region to 1.5 mm and then in the ferritic region to 0.7 mm. Such a steel appears to be too thick for use as a deep-drawing steel for can bodies.

EP-A-0 370 575 describes a process for the manufacture of formable steel strip in which molten steel is continuously cast into a slab of less than 100 mm, which slab is then, if desired after prereduction, cooled into the ferritic region and in that region rolled to a final thickness of between 0.5 and 1.5 mm.

EP-A-0 306 076 describes a method for the manufacture of formable steel strip in which, in a continuous process a slab having a thickness of less than 100 mm is cast, which slab is rolled in the austenitic region to a strip of a thickness of between 2 and 5 mm. This strip is cooled down into the ferritic region above 300° C. and rolled in that region to a final thickness of between 0.5 and 1.5 mm.

SUMMARY OF THE INVENTION

The object of the invention is to provide a method for the manufacture of a deep-drawing steel from steel grades of low carbon steel, particularly steels having carbon contents of between 0.1% and 0.01%. By the method it is possible, with a high material yield, to achieve a small finished thickness, and other advantages may also be attained.

In accordance with the invention there is provided a method for the manufacture of steel strip or sheet, suitable for use as deep-drawing steel for the manufacture of can bodies by deep-drawing and ironing, comprising the steps of (i) forming a liquid low carbon steel into a cast slab having a thickness of less than 100 mm by means of a continuous casting machine, (ii) rolling the slab in the austenitic region while making use of the casting heat to reduce its thickness to a transfer thickness, (iii) cooling the rolled slab from step (ii) having the transfer thickness into the ferritic region, (iv) rolling the rolled slab from step (iii) in the ferritic region to a finished thickness, wherein the transfer thickness is less than 1.5 mm and the total thickness reduction in the ferritic region from the transfer thickness to said finished thickness is less than 90% and more than 75%. The strip or sheet made by this method has the advantage of a reduced tendency to earing in subsequent deep-drawing and ironing. The degree of anisotropy depends on the carbon concentration and the total rolling reduction which the deep-drawing steel underwent in the ferritic region.

The invention is based on the further insight that the total reduction in the ferritic region following transition from the austenitic range is important for the ear formation, and that ear forming can be prevented or limited by keeping the reduction in cold-rolling in the ferritic region within a given limit with a given carbon content by entering the ferritic range with a sufficiently thin strip.

In a preferred embodiment of the method in accordance with the invention the total reduction by rolling in the ferritic region is not more than 88%, more preferably not more than 87%. The degree of rolling reduction whereby the minimum of anisotropy occurs is dependent on the carbon concentration and is the greater the smaller the carbon concentration. In the case of low carbon steel the cold-rolling reduction for minimum anisotropy and so for minimum ear formation, is in the range of less than 87% or more preferably less than 85%. In connection with good forming properties it is preferable for the total reduction to be more than 75% and more preferably more than 80%. the finished thickness of the steel may be less than 0.20 mm, even less than 0.15 mm.

The reduction to be carried out in the ferritic region may be kept small with a small finished thickness in the case of a preferred form of the invention in which the transfer thickness is less than 1.5 mm.

By the method of the invention a deep-drawing steel is provided that may be manufactured using generally known technology and with a generally known apparatus and which makes it possible to manufacture thinner deep-drawing steel than it was possible to achieve until now. In particular, known techniques may be used for the rolling and further processing in the ferritic range.

It is conventional to manufacture a steel strip by starting with a cast steel slab with a thickness of between 50 mm and 250 mm, varying according to the casting technology available in practice. Such a method may be used in this invention. Possibly following a pre-reduction, such a cast slab is cooled to ambient temperature, temporarily stored and possibly repaired, then reheated to within the austenitic range. The slab is hot-rolled in the austenitic range to a desired transfer thickness. With conventional processes in practice this is 1.8 mm or greater. The slab is then rolled in the ferritic range into the strip of the desired finished thickness.

In a preferred embodiment of the method in accordance with the invention the steel strip is manufactured by continuously casting molten low-carbon steel into a slab and rolling said slab in the austenitic region to the transfer thickness, without cooling said slab out of the austenitic region. Preferably this method makes use of the casting heat in a continuous process, i.e. the steel as a whole is not subjected to reheating at least until the transfer thickness is reached, except for any heat generated by the rolling processes.

This embodiment produces the advantage that the number of individually separate process stages is small. This leads to a higher material yield because the run-in and run-out stages are eliminated. Moreover, when use is made of the casting heat in the slab for the rolling in the austenitic range, a higher energy yield is attained. Furthermore, because the method has a greater degree of continuity, it can be carried out with a more lightly built installation. In this context a continuous process is also understood to include a process in which the steel slab is temporarily stored in a coiling apparatus, also known as a coil-box, in the austenitic range and thus while making use of the casting heat.

A problem when hot-rolling a slab is that during the rolling the temperature of the slab drops due to radiation loss and heat dissipation to the cooled rolls. A temperature drop under the austenitic range is undersirable on account of the quality requirements and controllability of the rolling process; any increase in the entry temperature, to avoid running beneath the austenitic range, is restricted by an accelerated oxide formation. Increasing the rolling speed is limited because of the tendency of the strip to start flying. To ensure that the slab can be rolled fully to the stated transfer thickness in the austenitic range, in a preferred embodiment of the method the slab on solidification after the continuous casting has a thickness of less than 100 mm, and step (ii) above comprises rolling the slab in the austenitic region into an intermediate slab, coiling the intermediate slab in a coiling apparatus, subjecting the intermediate slab to temperature homogenisation in at least one of a furnace apparatus arranged prior to the coiling and the coiling apparatus, and rolling the intermediate slab, after uncoiling from the coiling apparatus, in the austenitic region to the transfer thickness.

With the furnace apparatus such as an induction furnace, heat loss that occurs mainly on the surface may if appropriate be compensated. If required, heat may also be removed, if the furnace is equipped for colling. Alternatively the furnace may provide for temperature homogenization. In the coiling apparatus a further temperature equalisation takes place between the surface of the slab and the core of the slab. The slab is also homogenised in the direction of its width for a better profile and better homogeneity of properties.

It will be clear to the expert that even when using only a furnace apparatus or only a coil-furnace at least a part of the this advantage can be attained, and than the invention is not limited to the combination of these two.

Because of the number and size of the reduction stages to be carried out in the austenitic range, it is advantageous to carry out the method so that the intermediate slab has a thickness of between 5 and 25 mm, more preferably 5 and 20 mm. This makes possible an optimum in the number of mill stands in a roughing installation located before the coiling apparatus and a temper-rolling installation located after it, and in the rolling capacity to be installed.

Of particular advantage is an embodiment of the method in which a non-oxidising gaseous atmosphere is maintained on the surface of the steel for at least part of the time it is in the austenitic range. A serious problem with rolling in the austenitic range is that oxide formation on the surface of the slab occurs more quickly the more the temperature increases, ultimately imposing a limit on the maximum entry temperature for the austenitic rolling. By processing the slab at least in part in a non-oxidising gaseous atmosphere, the formation of an oxide layer is in any event limited. This means that a higher entry temperature or a shorter period of stay may be selected in the austenitic range. Consequently it is possible in a relatively simple manner to achieve the desired transfer thickness of less than 1.8 mm and even of less than 1.3 mm. On a small scale it has been found possible to achieve transfer thicknesses of around 1.0 mm.

In a particularly effective embodiment of the method in accordance with the invention a non-oxidising gaseous atmosphere is maintained in at least one of the furnace apparatus and the coiling apparatus, or in both. In a conventional furnace apparatus the slab is exposed to the surrounding gaseous atmosphere for a relatively long time and without being protected. Making this gaseous atmosphere non-oxidizing achieves the effect that at least in the furnace apparatus less oxide forms or none forms at all. The coiled slab stays in the coiling apparatus for a relatively long time at a relatively high temperature. Maintaining a non-oxidizing atmosphere in the coiling apparatus achieves the effect that no oxide scale can form which otherwise might be considerable, especially because of the high temperature of the slab.

The invention can be carried out in a plant for the manufacture of steel strip or sheet, having (a) a continuous casting machine for casting a steel slab, (b) a furnace apparatus for adjusting the temperature of the slab from the continuous casting machine, having an enclosure having an entry port, an exit port and a path for traversing by the slab from the entry port to said exit port, said enclosure maintaining a desired atmosphere at the path, (c) a coiling apparatus for coiling the slab from the furnace apparatus, having an enclosure providing an enclosed space for a coil and maintaining a desired atmosphere in the enclosed space, the enclosure of the coiling apparatus having an entry port for the slab, (d) an austenitic rolling apparatus for rolling the slab to a transfer thickness in the austenitic region, after uncoiling from the coiling apparatus, and (e) a ferritic rolling apparatus for rolling the slab having said transfer thickness in the ferritic region into strip or sheet having a desired final thickness, wherein the exit port of the furnace apparatus is substantially gas-tightly and detachably connectable to the entry port of said coiling apparatus. The plant may also have means for reducing the thickness of the slab between the continuous casting machine and the furnace apparatus.

Preferably the plant has means for providing a non-oxidising atmosphere in contact with said slab in at least one of the furnace apparatus and the coiling apparatus.

Such as apparatus and its advantages and specific embodiments are described in the International patent application "Plant for the manufacture of steel strip" with the same filing date as the present application and in the name of the same applicant, with reference no. HO 848. The content of that application is deemed to be included in the present application by this reference.

Typically the furnace apparatus is built as an electric furnace in which, by means of resistance or inductive heating, energy is supplied to the slab, so that the surface of the slab is heated again after having cooled as a consequence of the descaling by high pressure water sprays and because of heat loss to the surroundings. In the case of conventional plants, during this heating the surface is exposed to the normal outside atmosphere along a relatively great distance and thus for a relatively long time, so that an oxide scale again forms on the surface, which under these conditions is a thin, tenacious layer which in practice cannot be completely removed with available very high water pressures and which ultimately must be removed by pickling.

The furnace apparatus may be employed only for homogenizing the temperature of the steel slab, or may be arranged to alter at least the core of the slab in temperature.

In the plant so provided, the slab is prevented from coming into contact with the outside atmosphere as it passes through even a relatively long furnace apparatus, so that oxide scale thereby forming on the outer surface of the slab is minimized.

As stated, the coiling apparatus is provided an enclosure, i.e. screening means, for maintaining the desired gaseous atmosphere in the coiling apparatus. In the case of a conventional plant, the slab is coiled at a relatively high temperature in the coiling apparatus and stored there for some time for temperature homogenising or for waiting for further processing in the rolling apparatus. With the plant, when the coiling apparatus has a non-oxidizing atmosphere, the slab is prevented from oxidising or oxidising further during its stay in the coiling apparatus. The coiling apparatus preferably has sealing means, such as a door for closing its entry port and maintaining the desired atmosphere in it, when it is detached from the furnace apparatus.

As mentioned, in the plant the exit of the furnace apparatus is coupled essentially gas-tightly and attachably to the coiling apparatus. This also achieves the benefit that from the time when it runs into the furnace apparatus until it is conveyed out of the coiling apparatus the slab does not come into contact with the outside air, but rather it is continually surrounded by a gaseous atmosphere of a desired composition. For this the gaseous atmosphere in the furnace apparatus and in the coiling apparatus may be the same or different.

Preferably the coiling apparatus is mobile and is movable from a position of connection to the furnace apparatus to a position for uncoiling of said slab into the austenitic rolling apparatus. This also minimizes time of contact with the ambient atmosphere.

The slab uncoiled from the coiling apparatus is rolled in a following finishing train into a hot-rolled strip with a thickness smaller than 1.8 mm, preferably smaller than 1.5 mm.

In order to keep the finishing train as simple as possible and as small as possible, and to limit the exit speed from the finishing train, it is preferable to make the thickness of the uncoiled slab as small as possible. In order to be able to coil this slab well, it is preferable for the coiling apparatus to be provided with a mandrel onto which the coil can be coiled. The crop end of a slab, whether or not roughened, is clamped onto the mandrel and then coiled in the coiling apparatus into the coil in a path determined by the mandrel. This forced path makes it possible to coil a wide range of thicknesses reliably. This achieves a great freedom in that part of the process taking place prior to coiling and it is also possible to coil thin, rolled slabs.

A conventional plant for the further processing of a hot-rolled strip comprises separate apparatuses for cold-reducing and annealing. For thin and mechanically strong cold-rolled steel, a once cold-rolled strip is annealed a first time and then again cold-rolled, annealed and temper-rolled, so-called double-cold-reduced steel (DCR).

The plant makes it possible to manufacture a hot-rolled strip of less than 1.3 mm in thickness. Such a strip may be further processed effectively in a cold-rolling apparatus which is provided, in succession, with a first cold-rolling train, a recrystallisation furnace and a second cold-rolling train. Because the starting material is thin hot-rolled strip, the apparatus may be built as installations placed in succession through which the strip to be processed runs in an essentially continuous process. This results in compact installation which moreover makes it possible to make DCR steel in a continuous process. Such DCR steel and its applications, are known, such as for example three-piece cans in the packaging industry.

For obtaining good forming properties it is preferable for the first cold-rolling train to be suitable for a reduction of at least 30% in one pass in at least one of the mill stands of the first cold-rolling train. With such a reduction sufficient deformation is applied in the steel for subsequent recrystallisation. In addition it is possible to reduce the material far enough that, following recrystallisation, it is possible to roll to the finished thickness with relatively simple mill stands.

A particularly compact and easily controlled apparatus is obtained with an embodiment in which the first cold-rolling train comprises three 4-high mill stands.

Good forming properties with a desired reduction are also to be achieved with an embodiment of the apparatus in which the second cold-rolling train comprises two mill stands, preferably two 6-high mill stands, although two 4-high stands are possible too.

The second cold-rolling train is preferably suitable for a reduction to a finished thickness smaller than 0.14 mm. This produces the advantage that it can be used to manufacture a cold-rolled strip or sheet in a virtually continuous process with a thickness which can otherwise only be achieved with the complicated technique of double-cold-rolling.

It will be clear to the expert that the compact installation comprising the first cold-rolling train, the recrystallisation furnace and the second cold-rolling train can also be used as an autonomous apparatus, or in a combination with an apparatus for the manufacture of an austenitically hot-rolled strip other than that described in this application. The compact installation is capable of making DCR grades of small thickness for known applications such as packaging material with a thickness of 0.14 mm or less.

INTRODUCTION OF THE DRAWINGS

The invention will be illustrated in the following by means of a description of a non-limitative example of a plant for carrying out the invention, with reference to the drawings.

In the drawings:

FIG. 1 is a schematic top-view of part of a plant for carrying out the invention, FIG. 2 is a schematic side-view of the plant of FIG. 1, and FIG. 3 is a schematic side view of a further part of the plant for carrying out the invention.

DESCRIPTION OF THE EMBODIMENT

Figure 1:
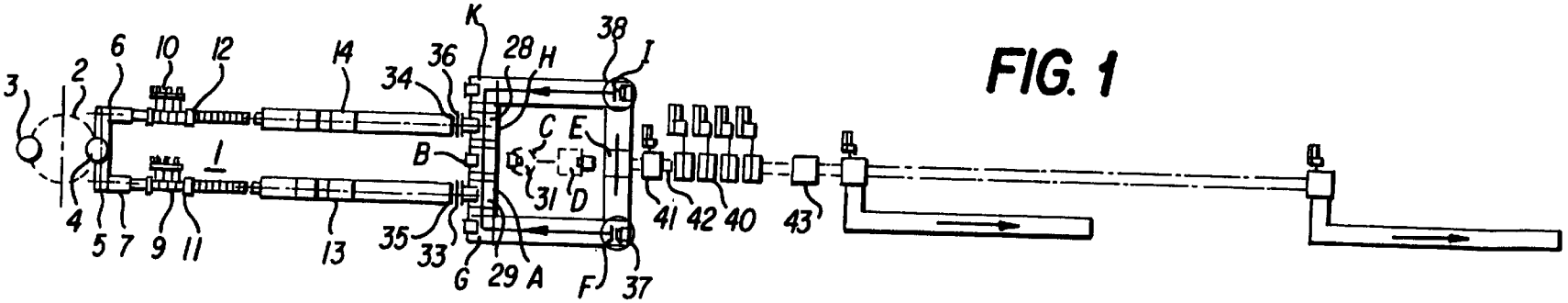
Figure 2:
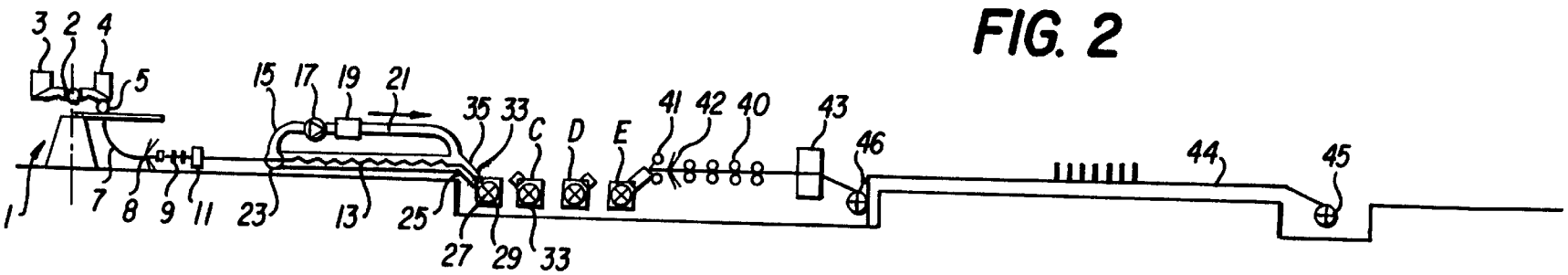

FIG. 1 shows a continuous casting machine 1 for two stands. The continuous casting machine 1 comprises a ladle turret 2 in which two ladles 3 and 4 can be accommodated. Each of the two ladles can contain approximately 300 tons of liquid steel. The continuous casting machine is provided with a tundish 5 which is filled from the ladles 3 and 4 and kept filled. The liquid steel runs out of the tundish into two moulds (not drawn) from where the steel, now in the form of a partially solidified slab with its core still liquid, passes between the rolls of curved roller tables 6 and 7. For some grades of steel it can be an advantage to reduce the steel slab in thickness in roller tables 6 and 7 while its core is still liquid. This is known as squeezing.

Descaling sprays 8 are located on the exit side of the two roller tables 6 and 7, by which oxide scale is sprayed from the slab with a water pressure of approximately 200 bar. Starting with a cast thickness of for example approximately 60 mm, the slab typically still has a thickness following squeezing of approximately 45 mm. By the 3-stand roll trains 9 and 10 the slab is further reduced to a thickness ranging from 10 to 15 mm. If desired the head and the tail may be cut off the slab by the shears 11 and 12, or the slab sheared into parts of a desired length.

Instead of casting a thin slab with a thickness of less than 100 mm, it is also possible to cast a thicker slab and by means of rolling, in particular by means of reversible rolling, to reduce the thickness of the slab to a value ranging from 10 to 15 mm.

In the method of the present invention the slab will generally be rolled into an intermediate slab with a thickness of 10 to 15 mm, as mentioned above. This rolled slab is conveyed into the furnace apparatus 13 or 14. The furnace apparatuses are each provided with heating means (not drawn), for example induction heating means, for heating the rolled slab up to a desired temperature in the austenitic region. The furnace apparatuses are in the form of enclosures and are provided with conditioning means for creating and preserving a desired non-oxidizing gaseous atmosphere in the furnace apparatus. In the embodiment shown the conditioning means of a furnace apparatus comprise a suction line 15, a pump 17, gas metering and gas scrubbing means 19 and a supply line 21 along which the gas is pumped into the furnace apparatus. If desired the gas metering and gas scrubbing means 19 may also comprise a gas heating apparatus for compensating for any heat loss. Thus heat exchangers can be employed to control the gas temperature, using gas combustion to supply heat, and water for cooling.

The gas atmosphere provided in the furnace apparatus and preferably also in the coiling apparatus is substantially non-oxidizing, though inevitably it may include a small amount of oxygen due to leakage of air. Preferably it is based on nitrogen, although an inert gas such as argon may be used it its high cost allows. The nitrogen may contain additive for inhibiting nitriding of the steel surface, as is known in the process of batch annealing of steel. The gas atmosphere may contain water vapour.

The furnace apparatus is provided on its entry and exit sides with ports 23, 25 having sealing means to substantially prevent any undesired penetration of gas from the surrounding atmosphere. A suitable value for the temperature of the reduced slab on exiting the furnace apparatus is 1080° C. The furnace apparatus is coupled essentially gas-tightly to the coiling apparatus 27, which coiling apparatus 27 itself comprises an essentially gas-tight enclosure in which the slab is coiled into a coil. The coiling apparatus is preferably provided with a mandrel 29 which supports the coil as it is being coiled.

In this embodiment, the gas atmosphere provided in the furnace apparatus also enters the coiling apparatus when the latter is connected to it. Alternatively both the furnace apparatus and the coiling apparatus may be provided with conditioning means, as described above, for providing the desired atmosphere.

As appropriate, virtually synchronously with coiling of a slab onto coiling apparatus 27, a slab cast on the other strand is coiled in coiling apparatus 28 provided with a mandrel (not drawn). Coiling apparatuses 27 and 28 and furnace apparatuses 13 and 14 are each provided with sealing means 33, 35, 34, 36 respectively, by which the coiling apparatuses and the furnace apparatuses may be sealed for uncoupling, so that following uncoupling no gas can penetrate from the outside atmosphere and the gaseous atmosphere in the coiling apparatuses and the furnace apparatuses remains preserved.

The sealing means for the ports of the furnace apparatuses and the coiling apparatuses are suitably steel flaps, biassed to the closed position, or they may be doors which are driven. To minimize gas leakage, flexible curtains may additionally be provided.

As soon as the coiling apparatus 27 is filled with a slab coiled into a coil, this coiling apparatus 27 is uncoupled from the furnace apparatus 13 and driven from position A (see FIG. 1) past position B to position C. At position C there is a turnstile 31 (not drawn) by which at position C the coiling apparatus may be rotated through 180° around a vertical axis. Following rotation the coiling apparatus is driven past waiting position D to entry position E. As a coiling apparatus travels from position A to position E, an empty coiling apparatus is driven from position E to a turnstile 37 at position F. Following rotation through 180° around a vertical axis by the turnstile 37, the coiling apparatus is driven past position G to the starting position A and there it is ready for taking up a fresh slab.

A corresponding working method is applicable for the second strand, whereby the coiling apparatus 28 filled with a coil is driven from position B to position C and following 180° rotation to position D. The coiling apparatus stays parked in this position until a coiling apparatus which is currently uncoiling, for example coiling apparatus 27, is empty at position E and driven off to the now vacated position F. As soon as coiling apparatus 28 leaves position B, an empty coiling apparatus from position I, following rotation through 180° around a vertical axis by means of a turnstile 38, is moved via position K to take up the position of the coiling apparatus 28 now driven off. The new slab fed out of the furnace apparatus 14 can be coiled in the empty coiling apparatus. Devices, preferably electrical current conductors (not shown), are fitted along the paths over which the coiling apparatuses travel for providing power for internally heating the coiling apparatuses according to need. For this purpose, the coiling apparatus contains electrical heaters for heating the coils and contacts for pick-up of power from the fixed conductors. Path B, C, D, E is common and used as described by coiling apparatuses of both strands. Position C has a rotation facility and position D is a waiting position in which a coiling apparatus filled with a coil is ready to be moved to position E as soon as it becomes free. Positions C and D may be swapped or may coincide.

In the manner described, a coiling apparatus 27 arrives at position E with its sealing means 33 closed and filled with a coil with a temperature of approximately 1080° C. After the sealing means 33 have been opened the extremity of the outer winding corresponding to the tail of the coiled slab is fed into the rolling train. If desired the head may be cut off by crop shears if it does not have a suitable shape or composition for further processing. Should some oxide still have occurred, this can then be removed easily using the high pressure spray 42. In practice oxide formation will be negligible because the slab has been almost constantly in a conditioned gaseous atmosphere. Because the coiling apparatus rotates through 180°, its original infeed which is now the outfeed can be brought up very close to the entry of the rolling train. This also minimizes oxide formation.

In the example shown, the rolling train 40 is provided with four mill stands and is so designed that the slab can be rolled in the austenitic region, or at least at such a temperature that only a small part converts to ferrite. A minimum target temperature of approximately 820° C. applies for low-carbon steel. For controlling thickness, width and temperature, a measuring and control apparatus 43 may be incorporated in the rolling train, after or between the mill stands.

As described above, the apparatus achieves the effect that less oxide forms as the slab and the strip are being processed. Because of this and because of the low entry speed in the last rolling train 40 which is achieves as an additional advantage, it is possible to attain a smaller than conventional finished thickness of the hot rolled steel. Exit thicknesses of 1.0 mm and less from the rolling train 40 can be attained with the plant described.

After exiting the rolling train 40, the hot-rolled strip passes through a colling line 44 in which the strip is cooled to a desired temperature in the ferritic range by means of water cooling. Finally the strip is coiled into a coil on the coiling apparatus 45. By selecting the cooling on the cooling line it is possible in a manner known in itself to influence the recrystallisation in the ferritic range and thereby influence the mechanical properties of the hot rolled strip.

Therefore, using the plant of FIG. 1 in this manner it is possible using the casting heat to manufacture in a successive series of process stages a austenitically rolled steel strip suitable for further processing described below. External heating after casting may be avoided (except any heat generated by the rolling).

Figure 3:
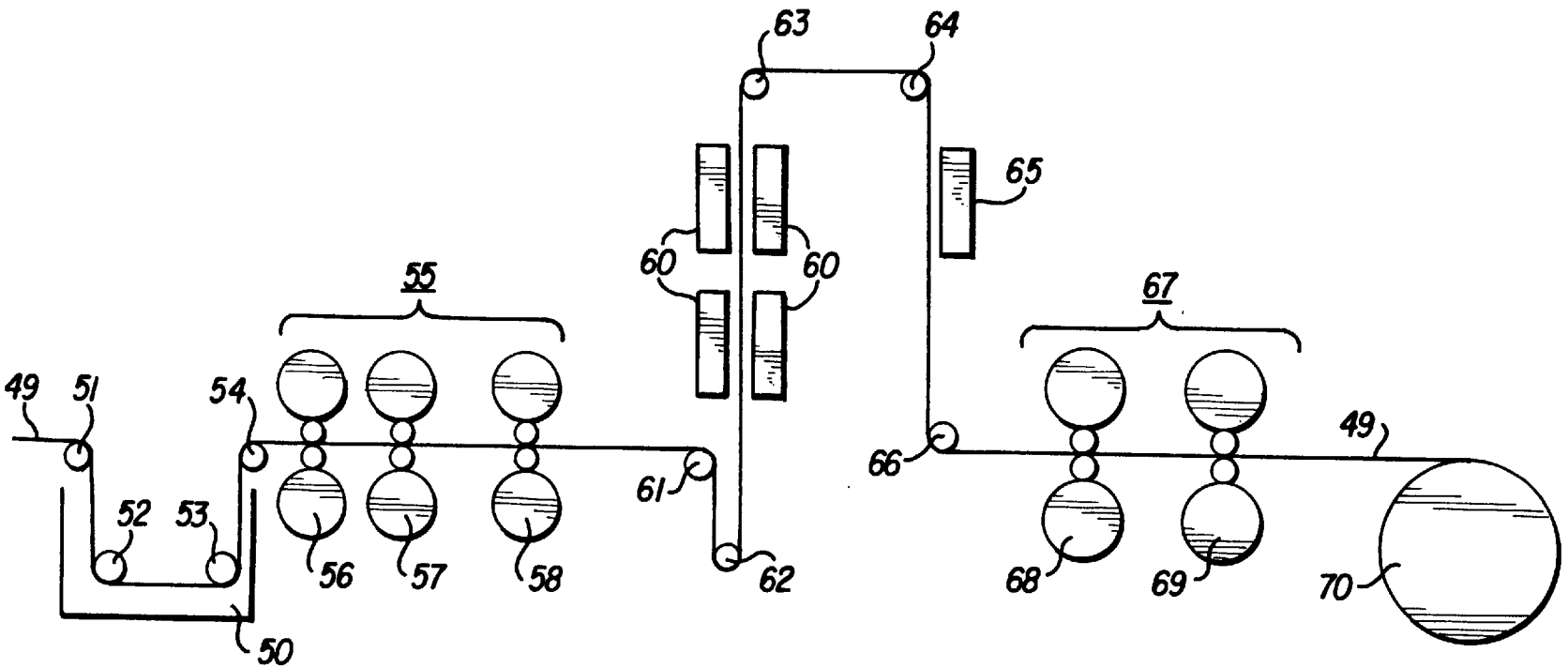

From the coiling apparatus 45 or directly from the cooling line 44 or using another manner of temporary storage, the hot-rolled strip is further processed in a cold-rolling apparatus as illustrated in FIG. 3.

FIG. 3 shows a pickling line 50 through which the strip 49 is led by means of deflector rolls 51, 52, 53, 54 for removing any oxide that might have occurred. After it has exited the pickling line the strip undergoes a first series of reduction stages in the first cold-rolling train 55 comprising three 4-high roll stands 56, 57, 58. In one of these roll stands, the thickness reduction is at least 30%. The strip is then recrystallized in the continuously operating recrystallisation furnace 60 at a desired temperature. To keep the installation compact the recrystallisation furnace is built as a vertical furnace. The strip is fed into and out of the furnace by making use of deflector rolls 61, 62, 63, 64. Having exited the furnace the strip may now be cooled in the cooling apparatus 65. Having been deflected around deflector roll 66 the strip is taken for a further thickness reduction into the second cold-rolling train 67 comprising two 6-high mill stands 68 and 69. Afterwards the strip 49 is coiled in coiling apparatus 70 or cut into pieces of desired lengths by a shearing apparatus, not drawn, of known type. If desired the strip may be provided with a coating prior to coiling or shearing.

Typical values for the thickness of the strip are: on entering the first rolling train approximately 1.0 mm, on exiting the first rolling train approximately 0.2 mm, on exiting the second rolling train approximately 0.12 mm. This gives a reduction in the ferritic region of 88%. As stated above, reductions of not more than 87% or even not more than 85% are preferred, in order to reduce "earing", and are clearly feasible with this apparatus.

What is claimed is:

1. A method for the manufacture of steel strip or sheet, suitable for use as deep-drawing steel for the manufacture of cans by deep-drawing and ironing, comprising the steps of:

(i) forming a liquid low carbon steel into a cast slab having a thickness of less than 100 mm by means of a continuous casting machine, (ii) rolling said slab in the austenitic region while making use of the casting heat to reduce its thickness of a transfer thickness, (iii) cooling the rolled slab from step (ii) having said transfer thickness into the ferritic region, (iv) rolling the rolled slab from step (iii) in the ferritic region to a finished thickness, wherein said transfer thickness is less than 1.5 mm and the total thickness reduction in the ferritic region from said transfer thickness to said finished thickness is less than 90% and more than 75%.

2. A method according to claim 1, wherein said total thickness reduction in the ferritic region is less than 87%.

3. A method according to claim 2, wherein said rolling in said step (iv) is at least partly cold-rolling.

4. A method according to claim 2, wherein said step (i) comprises continuously casting molten low-carbon steel into a slab and rolling said slab in the austenitic region to said transfer thickness, without cooling said slab out of the austenitic region.

5. A method according to claim 2, wherein for at least part of the time where said slab is in the austenitic region, it is maintained in a non-oxidizing gaseous atmosphere.

6. A method according to claim 1, wherein said rolling in said step (iv) is at least partly cold-rolling.

7. A method according to claim 6, wherein for at least part of the time where said slab is in the austenitic region, it is maintained in a non-oxidizing gaseous atmosphere.

8. A method according to claim 6, wherein in said step (iv) the steel being rolled is passed through successively a first cold-rolling train, a recrystallization furnace and a second cold-rolling train.

9. A method according to claim 4, wherein said slab on solidification after said continuous casting has a thickness of less than 100 mm, and said step (i) comprises rolling said slab in the austenitic region into an intermediate slab, coiling said intermediate slab in a coiling apparatus subjecting said intermediate slab to temperature homogenization in at least one of a furnace arranged prior to said coiling and said coiling apparatus, and rolling said intermediate slab, after uncoiling from said coiling apparatus, in the austenitic region to said transfer thickness.

10. A method according to claim 8, wherein said first cold-rolling train comprises at least one mill-stand which effects a thickness reduction of at least 30% in one pass.

11. A method according to claim 10, wherein said second cold-rolling train effects reduction to said finished thickness which is less than 0.14 mm.

12. A method according to claim 8, wherein said second cold-rolling train effects reduction to said finished thickness which is less than 0.14 mm.

13. A method according to claim 1, wherein said step (i) comprises continuously casting molten low-carbon steel into a slab and rolling said slab in the austenitic region to said transfer thickness, without cooling said slab out of the austenitic region.

14. A method according to claim 13, wherein said slab on solidification after said continuous casting has a thickness of less than 100 mm, and said step (i) comprises rolling said slab in the austenitic region into an intermediate slab, coiling said intermediate slab in a coiling apparatus subjecting said intermediate slab to temperature homogenization in at least one of a furnace arranged prior to said coiling and said coiling apparatus, and rolling said intermediate slab, after uncoiling from said coiling apparatus, in the austenitic region to said transfer thickness.

15. A method according to claim 14, wherein a non-oxidizing gaseous atmosphere is maintained in at least one of said furnace and said coiling apparatus, while said intermediate slab is present.

16. A method according to claim 14, wherein said intermediate slab has a thickness in the range 5 to 20 mm.

17. A method according to claim 14, wherein said intermediate slab has a thickness in the range 5 to 25 mm.

18. A method according to claim 17, wherein a non-oxidizing gaseous atmosphere is maintained in at least one of said furnace and said coiling apparatus, while said intermediate slab is present.

19. A method according to claim 1, wherein for at least part of the time where said slab is in the austenitic region, it is maintained in a non-oxidizing gaseous atmosphere.

* * * * *

UNITED STATES PATENT AND TRADEMARK OFFICE

CERTIFICATE OF CORRECTION

PATENT NO. : 6,109,336
DATED : August 29, 2000
INVENTOR(S) : Cornelis Pronk and Huibert Willem Den Hartog It is certified that error appears in the above-identified patent and that said Letters Patent is hereby corrected as shown below:

Claim 1,
Line 8, after "thickness" change "of" to -- to --.

Signed and Sealed this

Fifth Day of March, 2002

*Attest:*

*Attesting Officer*

JAMES E. ROGAN
*Director of the United States Patent and Trademark Office*